US005522756A

United States Patent [19]

Barthold

[11] Patent Number: 5,522,756

[45] Date of Patent: Jun. 4, 1996

[54] AIR DRIVEN SOUND GENERATING TOY USING MALLEABLE MATERIAL

[75] Inventor: Mark J. Barthold, Redondo Beach, Calif.

[73] Assignee: Mattel, Inc., El Segundo, Calif.

[21] Appl. No.: 310,542

[22] Filed: Sep. 22, 1994

[51] Int. Cl.[6] ..... A63H 3/31; A63H 29/10; A63H 29/00

[52] U.S. Cl. ..... 446/193; 446/197; 446/429

[58] Field of Search ..... 446/193, 192, 446/188, 180, 176, 197, 211, 51, 54, 56, 62, 429

[56] References Cited

U.S. PATENT DOCUMENTS

| | | | |
|---|---|---|---|
| 1,200,256 | 10/1916 | Steiner . | |
| 1,771,991 | 8/1930 | Bissiri | 446/62 |
| 2,022,107 | 11/1935 | Denivelle et al. . | |
| 2,919,135 | 12/1959 | Marchionda | 446/197 X |
| 3,205,610 | 9/1965 | Palumbo et al. . | |
| 3,469,340 | 9/1969 | Breneman et al. | 446/197 |
| 3,691,675 | 9/1972 | Rodgers . | |
| 3,739,764 | 6/1973 | Allport | 446/429 X |
| 3,846,934 | 11/1974 | Thorn et al. . | |
| 4,109,608 | 8/1978 | Horikawa . | |
| 4,114,501 | 9/1978 | Tanaka . | |
| 4,121,373 | 10/1978 | Slowe et al. . | |
| 4,149,338 | 4/1979 | Wolf . | |
| 4,159,705 | 7/1979 | Jacoby | 446/176 X |
| 4,162,106 | 7/1979 | Lawrence et al. | 446/176 X |
| 4,224,760 | 9/1980 | Birdsall et al. . | |
| 4,271,744 | 6/1981 | Kulesza . | |
| 4,276,713 | 7/1981 | Crosbie . | |
| 4,391,061 | 7/1983 | Fogarty et al. . | |
| 4,725,256 | 2/1988 | Sassak | 446/176 |
| 5,169,153 | 12/1992 | Levy et al. . | |

*Primary Examiner*—Mickey Yu
*Assistant Examiner*—D. Neal Muir
*Attorney, Agent, or Firm*—Roy A. Ekstrand

[57] ABSTRACT

An air driven sound generating toy includes a support base having a bellows housing secured thereto. A bellows chamber is supported within the bellows housing and is coupled to a collapsible resilient air bellows. A tube receptacle is supported by the base and operatively coupled to the bellows chamber. A pair of check valves are supported within the bellows chamber to provide a stream of pressurized air into the tube receptacle as the bellows is successively collapsed and expanded. An elongated hollow sounding tube includes opposed end portions each couplable to the tube receptacle in an alternative attachment. A quantity of malleable play material is received within the interior passage of the sound tube and is caused to move upwardly through the sound tube as the air bellows is operated to produce pressurized air within the tube receptacle and sound tube. In addition to moving the play material, the pressurized air is, in part, forced past the play material to produce an unusual and entertaining sound effect.

16 Claims, 3 Drawing Sheets

AIR DRIVEN SOUND GENERATING TOY USING MALLEABLE MATERIAL

FIELD OF THE INVENTION

This invention relates generally to sound generating toys and particularly to those having an air-powered sound generating system.

BACKGROUND OF THE INVENTION

For many years, practitioners in the art have provided a great variety of air driven sound generating toys. Such toys have included musical instruments, noise-makers, and toys combining the sound generating process with other entertainment aspects such as movable objects or the like. To maintain the user interest in such sound generating toys, practitioners in the art have endeavored to provide a variety of sounds ranging from musical notes or tones to popping or exploding sounds as well as sounds typically associated with other types of "noise-makers".

For example, U.S. Pat. No. 1,200,256 issued to Steiner sets forth a SOUND PRODUCING DEVICE FOR TOYS AND THE LIKE having a flexible base supporting an air driven bellows in combination with an air operated sounding reed. A plurality of check valves or one-way valves are operative to apply air pressure to the sounding reed.

U.S. Pat. No. 3,205,610 issued to Plumbo, et al. sets forth a PNEUMATIC TOY STOVE AND ACCESSORIES in which a hollow base housing supports a movable bellows together with an inflatable balloon coupled thereto. The bellows and balloon are further coupled to a simulated teapot sitting upon the upper housing and having an air driven whistle supported therein. In operation, the bellows are manipulated to inflate the balloon and provide a source of pressurized air which is coupled to the whistle to simulate a teapot boiling over and producing a whistle sound.

U.S. Pat. No. 3,691,675 issued to Rodgers sets forth an JACK IN THE BOX SOUNDER having a drum-shaped housing within which an expandable bellows is supported. A pop-up figure is supported upon the upper end of the bellows such that the bellows are compressed when the figure is pushed into the box and expanded when the figure pops up. An air-operated sounder is arranged in a passageway inside the bellows for making a sound when air moves through the passageway.

U.S. Pat. No. 4,109,608 issued to Horikawa sets forth a SOUND PRODUCING DEVICE which includes a movable frame and a flexible and air-tight sealed cylindrical bag enclosed therein. A bellows is extendable and compressible in an axial direction as the frame moves to compress air contained therein and release it. The compressed air is directed against a paper member which ruptures to produce the sound.

U.S. Pat. No. 4,149,338 issued to Wolf sets forth a CHILD'S TOY AND GAME having a base housing supporting a simulated flower and an air bellows. The air bellows is operatively coupled to a nozzle within the simulated flower which receives an inflatable balloon having a sounding device supported within the balloon neck. In operation, the balloon neck is sealingly received upon the nozzle within the simulated flower and inflated by the bellows operation. When sufficient pressure is formed within the balloon, the balloon breaks loose from the simulated flower and is driven about by air passing through the neck which in turn produces a whistling sound.

U.S. Pat. No. 4,391,061 issued to Fogarty, et al. sets forth a MUSICAL TOY having a plurality of identical pneumatic systems each for actuation of one of a plurality of vertically movable ornaments. Each of the pneumatic systems consists of an air manifold in fluid communication with a bellows, a whistle and a vertical tube having a piston movably positioned therein.

U.S. Pat. No. 4,271,744 issued to Kulesza sets forth a MUSICAL TOY having a base support and a vertically extending bellows. An air tube is connected to the bellows and to a musical instrument such as a harmonica or a plurality of whistles. The instruments is selectively moved relative to the outlet of air from the air tube to create a different pattern of sounds as the bellows are operated to drive air through the tube.

U.S. Pat. No. 4,114,501 issued to Tanaka sets forth a MUSICAL TOY having a plurality of separately operated dolls each having flexible bellows provided with an air chamber and an outlet. Each further includes a passageway connecting the outlet of the bellows to a passageway. The various dolls are sized to produce predetermined musical notes wherein each of the dolls is provided with indicia designating the particular note.

U.S. Pat. No. 4,121,373 issued to Slowe, et al. sets forth a SOUNDING MECHANISM FOR TOY ANIMALS which comprises a sound housing having an air inlet chamber, an air outlet resignator chamber and an air passage interconnecting the two chambers. A pair of primary and secondary vibratory reeds are coupled together and mounted in the inlet chamber. Apparatus is provided for sucking air through the inlet chamber and forcing air outwardly through the outlet chamber in succession for initiating vibration of the reeds.

Various other air-operated toys have been provided utilizing similar air driving apparatus such as U.S. Pat. No. 4,224,760 issued to Birdsall, et al. which sets forth a BUBBLE BLOWING DOLL and U.S. Pat. No. 4,276,713 issued to Crosbie which sets forth a PERCOLATING BUBBLE GENERATOR as well as U.S. Pat. No. 5,169,153 issued to Levy, et al. which sets forth a three-dimensional board game with audible sound generator and method of play having sounding game pieces which fall through air tubes.

Finally, U.S. Pat. No. 3,846,934 issued to Thorn, et al. sets forth a KISSING DOLL ACTUATED BY PRESSURE APPLIED TO LIP having an air bellows drive mechanism operated therein and U.S. Pat. No. 2,022,107 issued to Denivelle, et al. sets forth a DOLL HAVING A CONTROLLABLE VOICE SOUNDER operated in response to gravitational forces as the doll position is changed.

While the foregoing described prior art devices have enjoyed some success and provided some increase in amusement value, there remains nevertheless a continuing need in the art for evermore improved sound generating toys.

SUMMARY OF THE INVENTION

Accordingly, it is a general object of the present invention to provide an improved sound generating toy. It is a more particular object of the present invention to provide an improved air driven sound generating toy which provides enhanced play value and amusement and incorporates the use of a malleable play material compound.

In accordance with the present invention, there is provided an air driven sound generating toy comprising: a housing; air pressure means for producing a flow of pressurized air; a sounding tube defining an interior passage coupled to the air pressure means; and a quantity of malleable play material received within the interior passage, the air pressure means operative to force the malleable play material through the interior passage and to force a portion of the flow of pressurized air past the play material to produce a sound.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
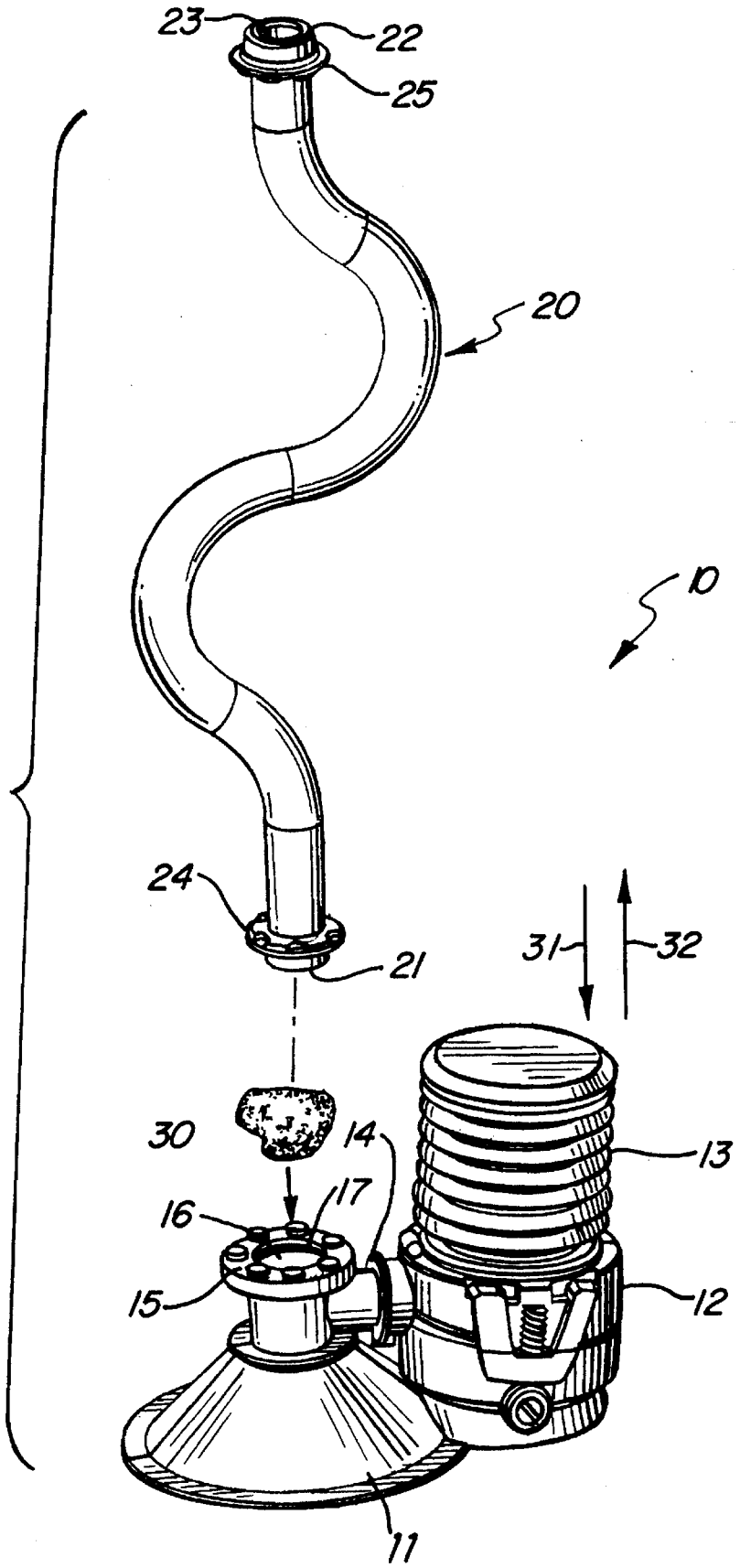
FIG. 1 sets forth a perspective assembly view of an air driven sound generating toy using malleable material constructed in accordance with the present invention.

FIG. 1 sets forth a perspective assembly view of an air driven sound generating toy constructed in accordance with the present invention and generally referenced by numeral 10. Toy 10 includes a base 11 having a bellows housing 12 and a tube receptacle 15 coupled thereto. An air coupling 14 extends between bellows housing 12 and tube receptacle 15. Tube receptacle 15 defines an upwardly opening passage 16 having a resilient seal 17 supported therein. Toy 10 further includes an elongated multiply curved sounding tube 20 having end portions 21 and 22 and an interior passage 23 extending therebetween. Passage 23 extends entirely through Sounding tube 20. In its preferred form, sounding tube 20 defines a generally circular cross-section hollow tube. A pair of end flanges 24 and 25 extend outwardly from sounding tube 10 near end portions 21 and 22 respectively.

Bellows housing 12 further supports a resilient multiply pleated air bellows 13 coupled to bellows housing 12 in a sealed coupling described below in greater detail. Suffice it to note here that downward pressure upon bellows 13 in the direction of arrow 31 collapses bellows 13 and pressurizes the interior of bellows housing 12. Conversely, the absence of downward pressure upon bellows 13 permits the natural resilience material from which bellows 13 is preferably formed to permit bellows 13 to expand upwardly in the direction indicated by arrow 32 and thereby draw a fresh supply of air into the interior of bellows housing 12. Coupling 14 provides air communication between the interior of bellows housing 12 and passage 16 of tube receptacle 15.

In operation, a quantity of malleable preferably elastic play material 30 is placed within end 21 of sounding tube 20 and forced upwardly a short distance into the end portion of passage 23. Thereafter, end 21 of sounding tube 20 is inserted into passage 16 of tube receptacle 15 until flange 24 contacts tube receptacle 15. During the insertion of end 21 of sounding tube 20 into passage 16, resilient seal 17 provides an air seal about the end portion of sounding tube 20.

Once a quantity of play material 30 has been deposited within the lower portion of sounding tube 20, the user depresses and releases bellows 13 to provide a flow of pressurized air through coupling 14 into passage 16 which in turn produces an air pressure generated force upon the undersurface of play material 30 driving it upwardly within sounding tube 20. As the user continues to depress and release bellows 13, successive bursts of pressurized air are forced against the underside of play material 30 driving it upwardly through sounding tube 20.

In addition to forcing play material 30 upwardly through sounding tube 20, the application of pressurized air to the underside of play material 30 forces some air past play material 30 producing an unusual and entertaining sound as it passes between play material 30 and the interior of passage 23. The sound produced changes in pitch as play material 30 is progressively driven upwardly through sounding tube 20 with the result that substantial entertainment and amusement is provided. In its preferred form, sounding tube 20 is sufficiently clear or transparent to permit the user to observe the upward movement of play material 30 further adding to the entertainment and amusement value.

It should be noted that, in its preferred form, sounding tube 20 is reversible in that either end 21 or end 22 may be inserted into passage 16 of tube receptacle 15 and bellows 13 thereafter actuated. Thus, the user may, for example, choose to initially place play material 30 within end 21 and insert end 21 into passage 16. Once the operation of bellows 13 has driven play material 30 upwardly a substantial distance and, for example, as play material 30 nears end 22 of sounding tube 20, the user may continue operation by simply removing sounding tube 20 and inverting it and thereafter inserting end 22 into passage 16. Once this is complete, play material 30 again occupies a lower portion of sounding tube 20 and may be driven upwardly once again through sounding tube 20 by manipulating bellows 13.

Figure 2:
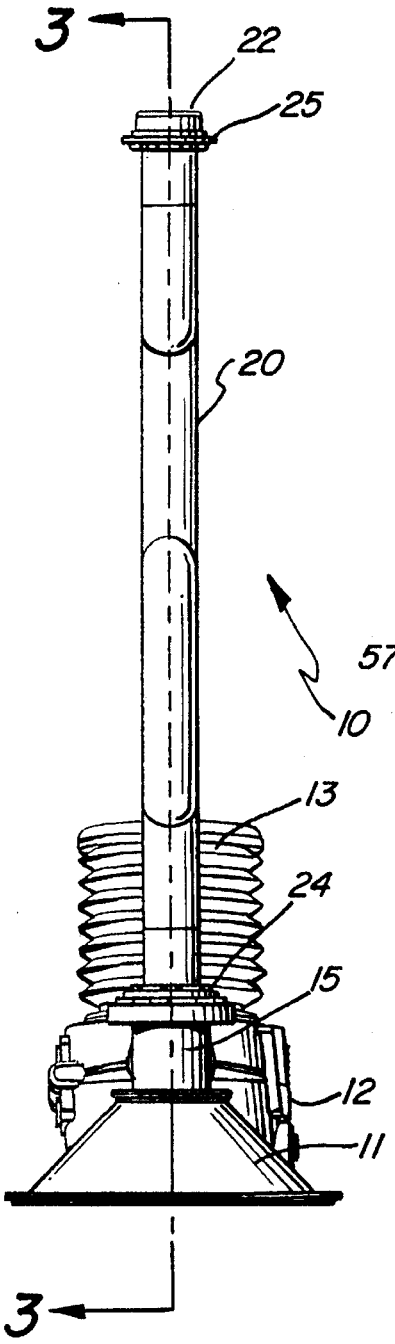
FIG. 2 sets forth a front view of the present invention air driven sound generating toy.

FIG. 2 sets forth a front view of toy 10 having sounding tube 20 assembled thereto. As described above, toy 10 includes a base 11 supporting a tube receptacle and having a bellows housing 12 coupled thereto. Bellows housing 12 supports a resilient pleated bellows 13 in the manner described above. As is also described above, a multiply curved preferably circular cross-sectioned sounding tube 20 defines end portions 21 and 22 each alternatively receivable within tube receptacle 15. In the example shown in FIG. 2, end 21 is received within tube receptacle 15 and maintained therein by a frictional fit within passage 16 and seal 17 (shown in FIG. 1). Alternatively, however, sounding tube 20 may be inverted placing end 22 within tube receptacle 15. Sounding tube 20 further defines support flanges 24 and 25 proximate ends 21 and 22 respectively to support sounding tube 20 in the generally vertical alignment shown in FIG. 2 within tube receptacle 15.

Figure 3:
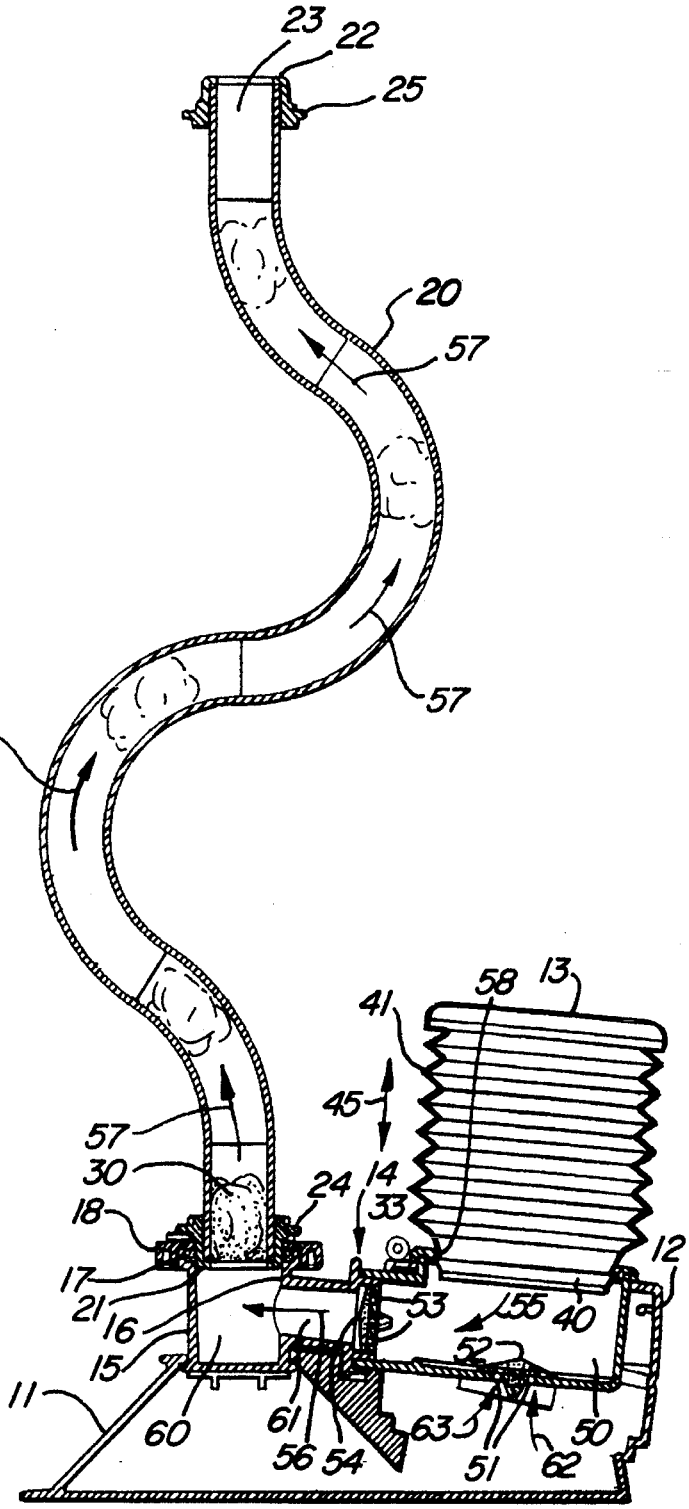
FIG. 3 sets forth a section view of the present invention air driven sound generating toy taken along section lines 3—3 in FIG. 2.

FIG. 3 sets forth a section view of toy 10 taken along section lines 3—3 in FIG. 2. Sound generating toy 10 includes a generally conical base 11 having a bellows housing 12 coupled thereto. Base 11 includes a tube receptacle 15 defining an interior pressure chamber 60 terminating in an upwardly opening passage 16. Passage 16 further supports a resilient O-ring type seal 17. An outwardly extending flange 18 encircles passage 16 and is secured to receptacle 15 to provide captivation of resilient seal 17.

Bellows housing 12 defines an interior bellows chamber 50 having a downwardly facing aperture 51 and a side facing aperture 53 formed therein. Bellows housing 12 further defines an annular lip 28 forming an upwardly facing generally circular aperture. A resilient air bellows 13 defines a plurality of collapsible pleats 41 and a lower lip 40. Lower lip 40 is received within lip 58 of bellows housing 12 to resiliently secure the lower end of bellows 13 to bellows housing 12 in an air sealed attachment.

A check valve 51 preferably formed of a resilient material and constructed in accordance with conventional fabrication techniques is secured to the lower surface of bellows chamber 50 and provides selective opening and closure of aperture 51. In its preferred form, a plurality of apertures 51 are formed in the lower surface of bellows chamber 50 beneath valve 52.

A similar valve 54 also preferably formed of a resilient material is secured to the sidewall of bellows chamber 12 and overlies aperture 53. In the preferred fabrication of bellows housing 12, a plurality of apertures 53 are formed in the sidewall of bellows chamber 50 and are positioned beneath resilient valve 54.

An air coupling 14 extends between bellows housing 12 and tube receptacle 15 and defines a coupling passage 61. Thus, tube receptacle 15 is in communication with bellows chamber 50 of bellow housing 12 through coupling passage 61 and valve 54 and apertures 53.

As described above, a curved sounding tube 20 preferably defines a circular cross-sectioned passage 23 extending between end portions 21 and 22 thereof. A pair of support flanges 24 and 25 are positioned upon sounding tube 20 proximate ends 21 and 22 respectively. As is also described above, either of ends 21 or 22 may be inserted into passage 16 of tube receptacle 15. In the illustration in FIG. 3, end 21 is received within passage 16 and is sealingly maintained therein by resilient seal 17.

In accordance with the present invention, a quantity of play material 30 is positioned within passage 23 of sounding tube 20 prior to assembly of sounding tube 20 to tube receptacle 15.

In operation, with play material 30 positioned within sounding tube 20, the user then repeatedly presses and releases bellows 13 causing bellows 13 to collapse and, upon release, expand upwardly to provide bellows movement in the up and down direction indicated by arrows 45. Upon each downward actuation of bellows 13, bellows 13 is collapsed reducing the volume thereof and causing an increased air pressure within bellows chamber 50. The increased air pressure within bellows chamber 50 forces valve 52 downwardly against the bottom surface of bellows chamber 50 closing apertures 51 and preventing air flow past valve 52. Simultaneously, the increased air pressure within bellows chamber 50 produces an air pressure force against the underside of valve 54 through apertures 53 forcing the resilient material of valve 54 to stretch and permitting the flow of pressurized air past valve 54 in the direction indicated by arrows 55 and 56. Conversely, when bellows 13 is released, the resilience of bellows 13 causes it to expand upwardly producing a reduced pressure or partial vacuum within bellows chamber 50. The reduced pressure within bellows chamber 50 causes valve 54 to be firmly pressed against the sidewall of bellows chamber 50 thereby preventing air flow into bellows chambers 50 and closing valve 54. Simultaneously, the reduced pressure within bellows chamber 50 permits the air pressure beneath bellows chamber 50 acting through apertures 51 to force valve 52 upwardly and permit air flow through apertures 51 into bellows chamber 50 in the direction indicated by arrows 62 and 63.

Thus, each time bellows 13 is collapsed downwardly, valve 52 closes and valve 54 opens forcing pressurizing air through coupling 14 via coupling passage 61. On the upward or expanding stroke of bellows 13, air is drawn upwardly through valve 52 via apertures 51 filling bellows chamber 50 with a renewed air supply. As successive strokes downward and releasing bellows 13 are applied, the pressure within pressure chamber 60 of receptacle 15 forces play material 30 upwardly in the direction indicated by arrows 57 to force play material 30 upwardly through passage 23. As described above, the characteristic of play material 30 within passage 23 also permits a portion of the pressurized air to escape between the sidewalls of sounding tube 20 and play material 30 thereby producing an unusual and entertaining sound effect which accompanies the visual effect of watching play material 30 progress upwardly through sounding tube 20. Because the effective air column length within sounding tube 20 beneath play material 30 changes as play material 30 moves upwardly, the pitch of sound produced changes correspondingly adding a further entertainment aspect to the operation of toy 10.

At some point, the user simply withdraws sounding tube 20 from tube receptacle 15 and inverts sounding tube 20 in order to insert end 22 within the tube receptacle. With sounding tube 20 thus inverted, the position of play material 30 is correspondingly changed permitting the user to continue a virtually endless operation of the present invention toy by successive inversions of sounding tube 20.

Figure 4:
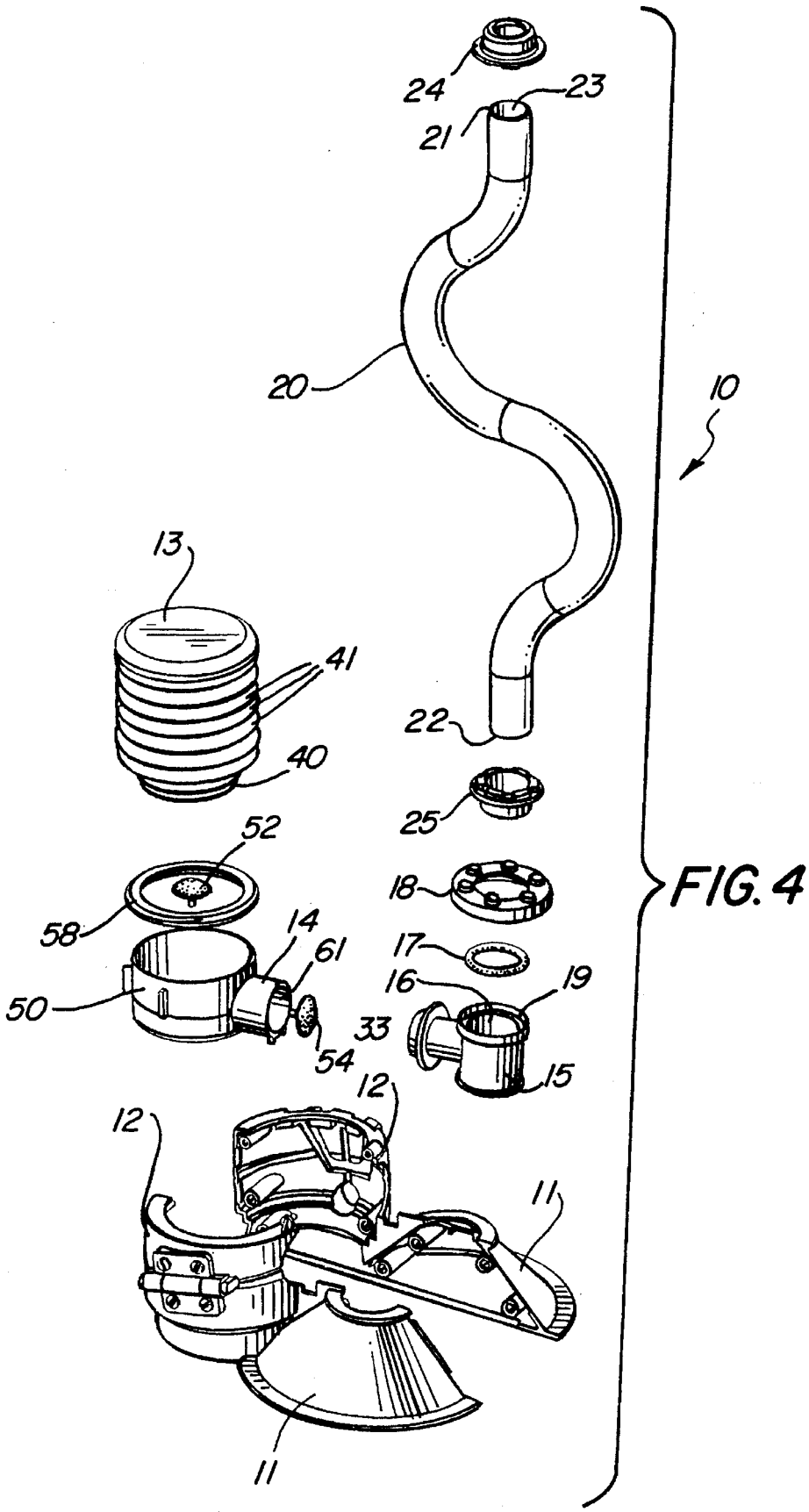
FIG. 4 sets forth a perspective assembly view of the present invention air driven sound generating toy.

FIG. 4 sets forth an exploded assembly view of the present invention air driven sound generating toy. Toy 10 includes a base 11 and a bellows housing 12 formed of molded half portions generally divided along a front to back center line. Thus, bellows housing 12 and base 11 are formed by joining the half portions thereof in a conventional attachment to provide a complete base and bellows housing. A bellows chambers 50 includes a coupling 14 having a coupling passage 61 formed therein. An annular lip 58 is received upon the upper portion of bellows chamber 50 to provide a receiving surface or bellows 13. Bellows chamber 50 is captivated between the half portions of bellows housing 12 and secured therein by conventional fabrication techniques such that coupling 14 extends laterally toward base 11. A tube receptacle 15 defining a generally T-shaped member having an upper groove 19 and a passage 16 formed therein is also received between the half portions of base 11 and secured thereto using conventional fabrication techniques. Tube receptacle 15 further defines a coupler 33 which is received within passage 61 of coupling 14 to complete the air communication passage between bellows chamber 50 and pressure chamber 60 and passage 16 formed within tube receptacle 15. In accordance with the fabrication set forth in FIG. 3, a valve 54 is received within bellows chamber 50 and supported therein as shown in FIG. 3. In further accordance with the structure set forth above in FIG. 3, a valve 52 is received upon the lower surface of bellows chamber 50 and secured thereto in the manner also shown in FIG. 3.

Bellows 13 defines a plurality of pleats 41 and a resilient lip 40. The latter is received within lip 58 in a resilient sealing attachment which secures bellows 13 to lip 58 and bellows chamber 50. As described above, bellows 13 is preferably formed of a resilient material such as molded plastic or the like and assumes the expanded position shown in the absence of a downward collapsing force applied by the user.

Toy 10 further includes a multiply curved preferably transparent sounding tube 20 having end portions 21 and 22 and supporting a pair of flanges 24 and 25 respectively. Flanges 24 and 25 may be secured to sounding tube 20 using conventional fabrication techniques such as sonic welding, adhesive attachment or the like. A resilient O-ring seal 17 is received within groove 19 of tube receptacle 15 afterwhich a covering flange 18 is secured to the upper surface of tube receptacle 15 captivating seal 17 within groove 19. Sounding tube 20 is assembled to tube receptacle 15 by inserting either end 22 or end 21 into passage 16 to form a sealing engagement with seal 17. As is better seen in FIG. 3, the insertion of either end of sounding tube 20 within tube receptacle 15 is supported by the cooperation of the corresponding flange with flange 18. In the example shown in FIG. 3, end 21 is assembled to tube receptacle 15 such that flange 24 assists in the support of sounding tube 20. Conversely, in the assembly shown in FIG. 4, end 22 and flange 25 are securable to tube receptacle 15 in the same manner. As is also described above, sounding tube 20 is reversible and may be secured by either of ends 21 or 22 in an alternating fashion to enhance the play pattern in the manner described above.

What has been shown is a new and improved novel air driven sound generating toy which utilizes a malleable play material to provide an unusual and entertaining sound generation together with the visual play pattern of observing the play material being progressively moved upwardly through the clear or transparent sounding tube. The reversible attachment of the sounding tube facilitates the continuous play by the user in a play pattern in which the air bellows are repeatedly pumped to move the play material and in which the play is continued by simply removing and inverting and thereafter reinstalling the sound tube to again place the play material at the lower end of the sound tube. In further accordance with the entertainment qualities of the present invention, the air column length defined beneath the play material changes correspondingly as the play material is moved through the sounding tube providing different pitch sounds as the game play progresses. It has been found that the user very quickly acquires considerable skill in manipulating the air bellows and sounding tube to produce a variety of entertaining sound effects.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An air driven sound generating toy comprising:

a housing;

air pressur means for producing a flow of pressurized air;

a sounding tube defining an interior passage and surrounding interior wall, said sounding tube being coupled to said air pressure means and having an open end; and a quantity of resilient amorphous malleable play material received within said interior passage, said material tending to adhere to said interior wall, said air pressure means operative to force said malleable play material through said interior passage and to deform said play material and force a portion of said flow of pressurized air past said play material to produce a sound.

2. An air driven sound generating toy as set forth in claim 1 wherein said sounding tube is generally transparent.

3. An air driven sound generating toy as set forth in claim 2 wherein said sounding tube defines a pair of coupling ends each alternatively coupled to said air pressure means.

4. An air driven sound generating toy as set forth in claim 3 wherein said air pressure means includes a tube receptacle for receiving either of said coupling ends.

5. An air driven sound generating toy as set forth in claim 4 wherein said air pressure means includes a resilient collapsible bellows and a bellows chamber, said bellows chamber being supported by said housing.

6. An air driven sound generating toy as set forth in claim 5 wherein said sounding tube is multiply curved.

7. An air driven sound generating toy as set forth in claim 6 wherein said sounding tube defines a generally circular cross-section.

8. An air driven sound generating toy as set forth in claim 1 wherein said air pressure means includes a resilient collapsible bellows and a bellows chamber, said bellows chamber being supported by said housing.

9. An air driven sound generating toy as set forth in claim 8 wherein said sounding tube is multiply curved.

10. An air driven sound generating toy as set forth in claim 9 wherein said sounding tube defines a generally circular cross-section.

11. A sound generating toy comprising:

a housing;

air pressure means producing a pressurized air flow supported by said housing and defining an air pressure coupling;

a sound tube having opposed ends each couplable to said air pressure coupling and a sounding passage, having smooth interior walls, therebetween; and a quantity of amorphous resilient deformable play material having a tendency to stick to said interior wall received within said sounding passage, said play material being moved within said sounding passage under the influence of said pressurized air flow and tending to adhere to said interior wall and be deformed by said pressurized air as a portion of air is forced past said play material to produce audible sound.

12. A sound generating toy as set forth in claim 11 wherein said sound tube defines a curved circular cross-section member.

13. A sound generating toy as set forth in claim 11 wherein said sound tube is transparent.

14. A sound generating toy as set forth in claim 11 wherein said air pressure means includes a resilient collapsible bellows and valve means for directing air from said bellows to said sound tube.

15. A sound generating toy as set forth in claim 14 wherein said sound tube defines a curved circular cross-section member.

16. A sound generating toy as set forth in claim 14 wherein said sound tube is transparent.

* * * * *